US008116508B2

(12) United States Patent
Xu et al.

(10) Patent No.: US 8,116,508 B2
(45) Date of Patent: Feb. 14, 2012

(54) DUAL-MODE LOUDSPEAKER

(75) Inventors: Liangfeng Leon Xu, Coppell, TX (US); Chenguang Cai, Beijing (CN); Jani K. Nurminen, Lempäälä (FI); Xia S. Wang, Beijing (CN); Antti O. Salo, Beijing (CN); Koray Ozcan, Farnborough (GB)

(73) Assignee: Nokia Corporation, Espoo (FI)

( * ) Notice: Subject to any disclaimer, the term of this patent is extended or adjusted under 35 U.S.C. 154(b) by 741 days.

(21) Appl. No.: 12/286,117

(22) Filed: Sep. 26, 2008

(65) Prior Publication Data

US 2010/0080409 A1 Apr. 1, 2010

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 25/00* | (2006.01) |

(52) U.S. Cl. ..... 381/396; 381/150

(58) Field of Classification Search ..... 381/77, 381/111, 396, 150, 122, 312, 345, 398
See application file for complete search history.

(56) References Cited

U.S. PATENT DOCUMENTS

| | | | | |
|---|---|---|---|---|
| 4,823,908 | A | 4/1989 | Tanaka et al. | 181/175 |
| 5,059,851 | A | 10/1991 | Corl et al. | 310/334 |
| 6,011,855 | A * | 1/2000 | Selfridge et al. | 381/111 |
| 6,324,907 | B1 | 12/2001 | Halteren et al. | 73/431 |
| 2004/0057596 | A1 | 3/2004 | Green et al. | 381/423 |
| 2004/0114770 | A1 | 6/2004 | Pompei | 381/77 |
| 2004/0247140 | A1 | 12/2004 | Norris et al. | 381/77 |
| 2005/0002536 | A1 | 1/2005 | Gorelik et al. | 381/150 |
| 2006/0136544 | A1 | 6/2006 | Atsmon et al. | 709/200 |
| 2007/0217616 | A1 | 9/2007 | Miyazaki | 381/15 |
| 2007/0223724 | A1 | 9/2007 | Miyazaki | 381/77 |

FOREIGN PATENT DOCUMENTS

| | | |
|---|---|---|
| JP | 2006 067386 | 3/2006 |
| JP | 2007 067514 | 3/2007 |
| WO | WO 2005/053357 | 6/2005 |

OTHER PUBLICATIONS

IEEE Sensors 2007 Conference; S. Je and J. Chae; "An Electromagnetically Actuated Micromachined Loudspeaker for Hearing Aids Applications"; pp. 1024-1027; May 2007.

Audio Engineering Society Convention Paper 6521; Y. Nakashima, T. Yoshimura and T. Ohya; "Prototype of Parametric Array Loudspeaker on Mobile Phone and its Acoustical Characteristics"; May 28-31, 2005.

J. Audio Engineering Society, "Loudspeaker Array Technology"; vol. 53, No. 11, pp. 1081-1084, Nov. 2005.

(Continued)

*Primary Examiner* — Walter L Lindsay, Jr.

(74) *Attorney, Agent, or Firm* — Ware, Fressola, Van Der Sluys & Adolphson LLP

(57) ABSTRACT

An apparatus uses a transducer to produce vibration in the ultrasonic frequency range and in the audible frequency range. A membrane or cantilever structure is coupled to the transducer to produce acoustic waves. When the vibration is in the audible frequency range, the membrane structure works like a conventional loudspeaker. When the vibration is in the ultrasonic frequency range, the ultrasonic signal is modulated by audio signal for creating better directivity. The acoustic waves in the ultrasonic frequency range can reproduce directional audible sound due to the nonlinear interaction of ultrasonic waves in air.

26 Claims, 9 Drawing Sheets

OTHER PUBLICATIONS

NTT DoCoMo Technical Journal; Y. Nakashima, T. Yoshimura, N. Naka and T. Ohya; "Prototype of Mobile Super Directional Loudspeaker"; pp. 25-32; vol. 8 No. 1.

NTT DoCoMo Technical Journal; H. Matsuoka, Y. Nakashima and T. Yoshimura; "Acoustic Communication System Using Mobile Terminal Microphones"; pp. 4-12; vol. 8 No. 2.

"The audio spotlight: An application of nonlinear interaction of sound waves to a new type of loudspeaker design", Masahide Yoneyama and Jun-ichiroh Fujimoto, May 1983, J. Accounst. Soc. Am 73(5), 1983 Acoustical Society of America. pp. 1532-1536.

* cited by examiner

DUAL-MODE LOUDSPEAKER

FIELD OF THE INVENTION

The present invention relates generally to a loudspeaker and, more particularly, to a loudspeaker that can be acoustically excited at different frequency ranges to produce audible sounds.

BACKGROUND OF THE INVENTION

A device, such as a gaming console, usually produces sound when the user plays a game with the console. When the user plays a game on such device in a public place, for example, sometimes it is desirable to let people around the user hear the sound. In other times, it is desirable to keep the sounds to the user so as not to disturb other people in the vicinity. Likewise, a mobile phone can be used for music playback and audio/video playback. There are times when the playback sound is to be shared with a group of people. There are times when the playback sound is to be heard mainly by the user so that others around the user are not disturbed.

SUMMARY OF THE INVENTION

The present invention provides a method and an apparatus that can be used to produce both audible acoustic waves in a wide beam and in a narrow beam. On the one hand, the apparatus is an acoustic component that can be acoustically excited to produce audible acoustic waves in a conventional way, for example. It can include a vibrating structural component (also called transducer) such as a membrane, a clamped-clamped beam, or a cantilever, or an array of such structures, which can be excited by a specific exciting signal so that it produces audible sound waves in the 20 Hz to 20 kHz range, for example. On the other hand, the apparatus can also be excited in a higher frequency range, such as an ultrasonic frequency range (about 30 kHz-120 kHz). When the vibration is in the ultrasonic frequency range, the ultrasonic signal is modulated by audio signal for creating better directivity. At this frequency range, the transducer or transducer array can produce a directional beam of ultrasonic waves. Due to the non-linear interaction of ultrasonic waves in the air, the directional beam of ultrasonic waves becomes audible after traversing a distance.

Thus, the first aspect of the present invention is a method for producing audible signals in a wide-beam audio mode or a narrow-beam audio mode. The method comprises providing an acoustic component configured to produce acoustic waves in a lower frequency range and a higher frequency range, the lower frequency range comprising at least part of the audible frequency range and the higher frequency range comprising a frequency range higher than the audible frequency range; and exciting the acoustic component for producing acoustic waves in the lower frequency range or in the higher frequency range.

According to various embodiments of the present invention, the higher frequency range comprises at least part of an ultrasonic frequency range, and the acoustic component comprises a transducer or transducer array configured to receive electrical signals for producing vibration in the ultrasonic frequency range based on the electrical signals. The transducer is also configured to produce vibration in the lower frequency range based on the electrical signals.

According to embodiments of the present invention, when the vibration is in the higher frequency range, the electrical signals are obtained by modulating an audible signal by a carrier signal in the ultrasonic frequency range.

In one embodiment of the present invention, a deflectable component is coupled to the transducer for producing the acoustic waves in response to the vibration.

The second aspect of the present invention is an apparatus for producing audible signals. The apparatus, comprises:

an acoustic component configured to produce acoustic waves in a lower frequency range or in a higher frequency range, the lower frequency range comprising at least part of the an audible frequency range and the higher frequency range comprising a frequency range higher than the audible frequency range. The higher frequency range comprises at least part of an ultrasonic frequency range, and the acoustic component comprises a transducer or transducer array configured to receive electrical signals for producing vibration in the ultrasonic frequency range based on the electrical signals. The transducer is also configured to produce vibration in the lower frequency range based on the electrical signals. When the vibration is in the higher frequency range, the electrical signals are obtained by modulating an audible signal modulated by a carrier signal in the ultrasonic frequency range.

According to one embodiment of the present invention, a deflectable component is coupled to the transducer for producing the acoustic waves in response to the vibration.

According to one embodiment of the present invention, the acoustic component comprises:

a substrate having a first side and an opposing second side, wherein a second side comprises a cavity defining a deflectable area on the substrate;

a piezoelectric layer; and a pair of electrodes coupled to the piezoelectric layer, the electrodes arranged to receive electrical signals so as to cause the piezoelectric layer to vibrate and wherein part of the deflectable area is acoustically coupled to the piezoelectric layer for producing the acoustic waves in response to vibration of the piezoelectric layer.

According to one embodiment of the present invention, the acoustic component comprises:

a substrate having a first side and an opposing second side, wherein a second side comprises an array of cavities, each cavity defining a deflectable area on the substrate;

a plurality of piezoelectric layer segments; and a pair of electrodes coupled to the piezoelectric layers, the electrodes arranged to receive electrical signals so as to cause the piezoelectric layers to vibrate and wherein each of the deflectable area is acoustically coupled to one of the piezoelectric layers for producing the acoustic waves in response to vibration of the piezoelectric layers.

According to one embodiment of the present invention, the acoustic component is operable in a first audio mode to produce acoustic waves in the lower frequency range and in a second audio mode to produce acoustic waves in the higher frequency range. The apparatus further comprises a processor, coupled to the acoustic component, for selecting between the first audio mode and the second audio mode; and a user interface, coupled to processor, for selecting between the first audio mode and the second audio mode.

The apparatus can be a mobile terminal, a portable device that provides music playback, video playback, camcording, games, radio or the like.

The present invention will become transparent upon reading the description taken in conjunction with FIGS. 1-10.

DETAILED DESCRIPTION OF INVENTION

Mobile phones and portable devices can include audio features. The audio features include music playback, video playback, camcording, games, radio and so forth. It has become common that these audio features are carried out in public places. It is desirable that those devices are capable of producing sounds in at least two ways: one using a conventional speaker that produces sound in a large range of solid angles (wide beam), and one producing sound in a directional pattern (narrow beam) so as not to disturb other people when the user listens to the sound in public.

The present invention provides a method and an apparatus that can be used to produce both audible acoustic waves in a wide beam and in a narrow beam. On the one hand, the apparatus is an acoustic component that can be acoustically excited to produce audible acoustic waves in a conventional way, for example. It can include a vibrating structural component (also called transducer) such as a membrane, a clamped-clamped beam, or a cantilever, or an array of such structures, which can be excited by a specific exciting signal so that it produces audible sound waves in the 20 Hz to 20 kHz range, for example. On the other hand, the apparatus can also be excited in a higher frequency range, such as an ultrasonic frequency range (about 30 kHz-120 kHz). At this frequency range, the transducer or transducer array can produce a directional beam of ultrasonic waves. Due to the non-linear interaction of ultrasonic waves in the air, the directional beam of ultrasonic waves becomes audible after traversing a distance. According to the present invention, the acoustic component that produces the audible sound in a conventional way is the same acoustic component that, when excited by ultrasound waves, produces substantially directional sound after the ultrasonic waves traverse a specific distance.

Figure 1:
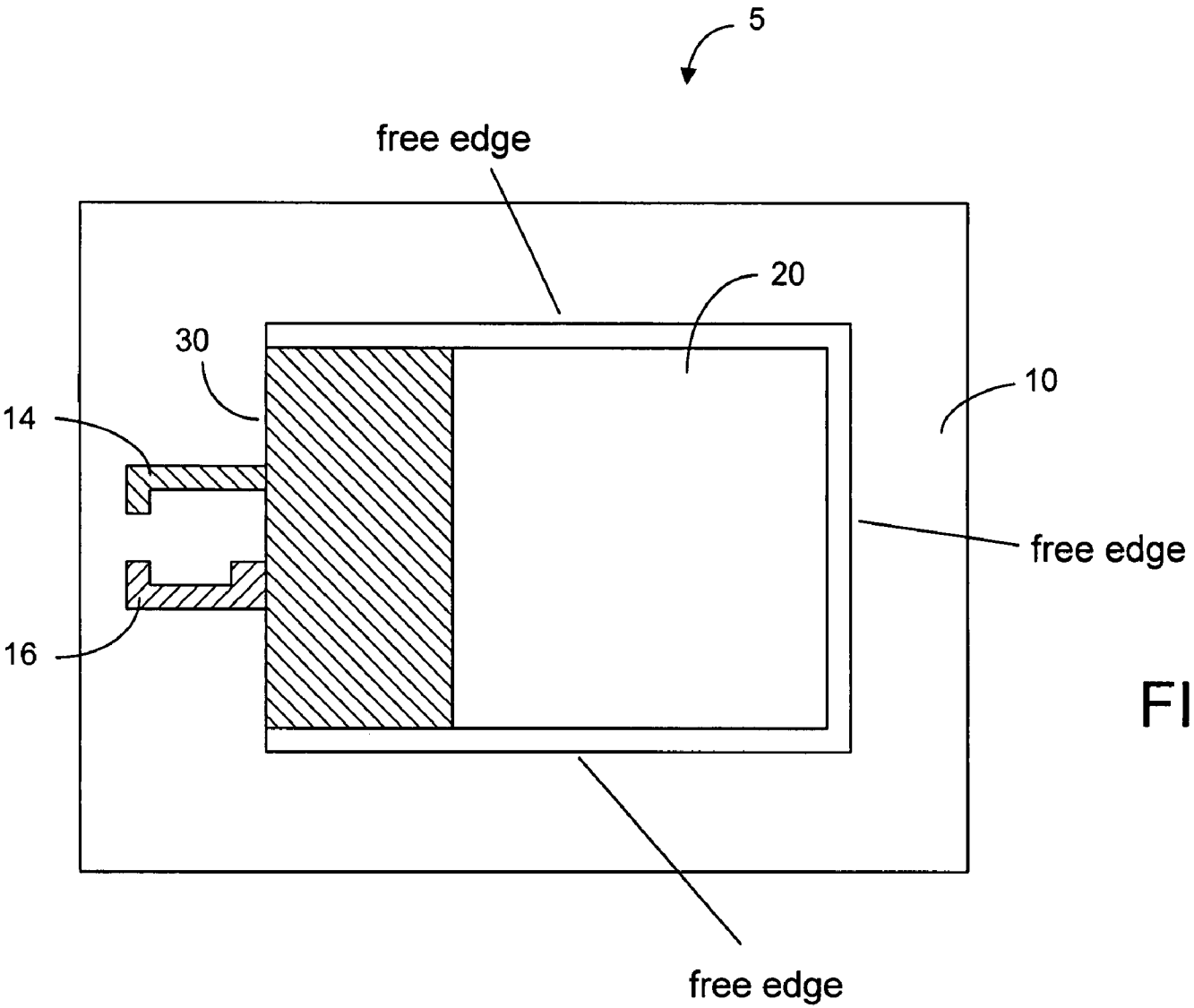
FIG. 1 is a top view of an acoustic device, according to one embodiment of the present invention.

FIG. 1 is a top view of an acoustic device, according to one embodiment of the present invention. As shown in this embodiment, the acoustic device is produced with a micro-electro-mechanical systems (MEMS) technology. For example, the acoustic device is produced on a silicon substrate 10. As shown in FIG. 1, the acoustic device 5 comprises a cantilever diaphragm 20 with free edges. Part of the cantilever diaphragm is acoustically coupled to a transducer 30, wherein the transducer 30 is connected to a pair of electrodes 14 and 16.

Figure 2:
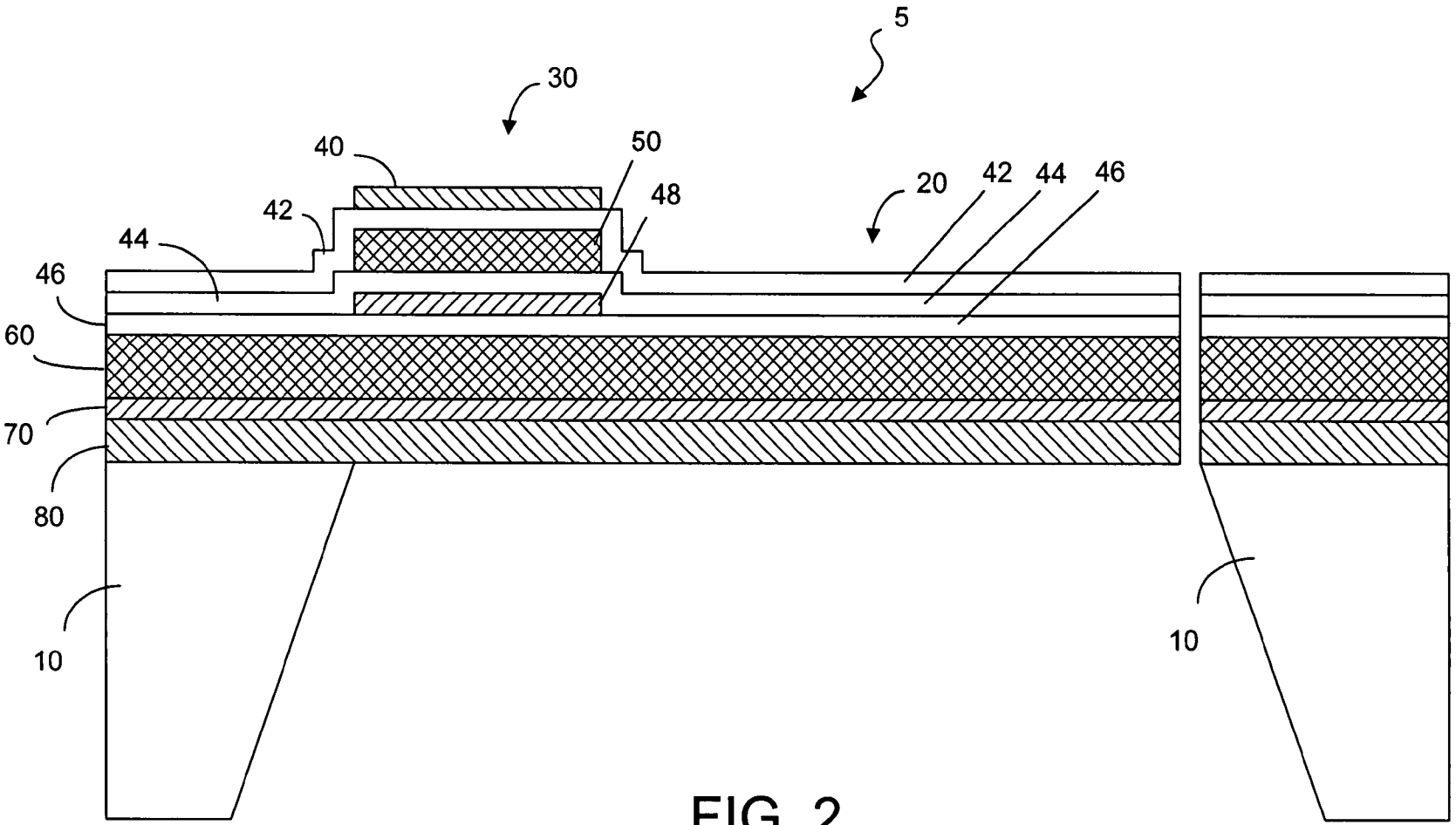
FIG. 2 is a cross sectional view of the acoustic device of FIG. 1.
Figure 3:
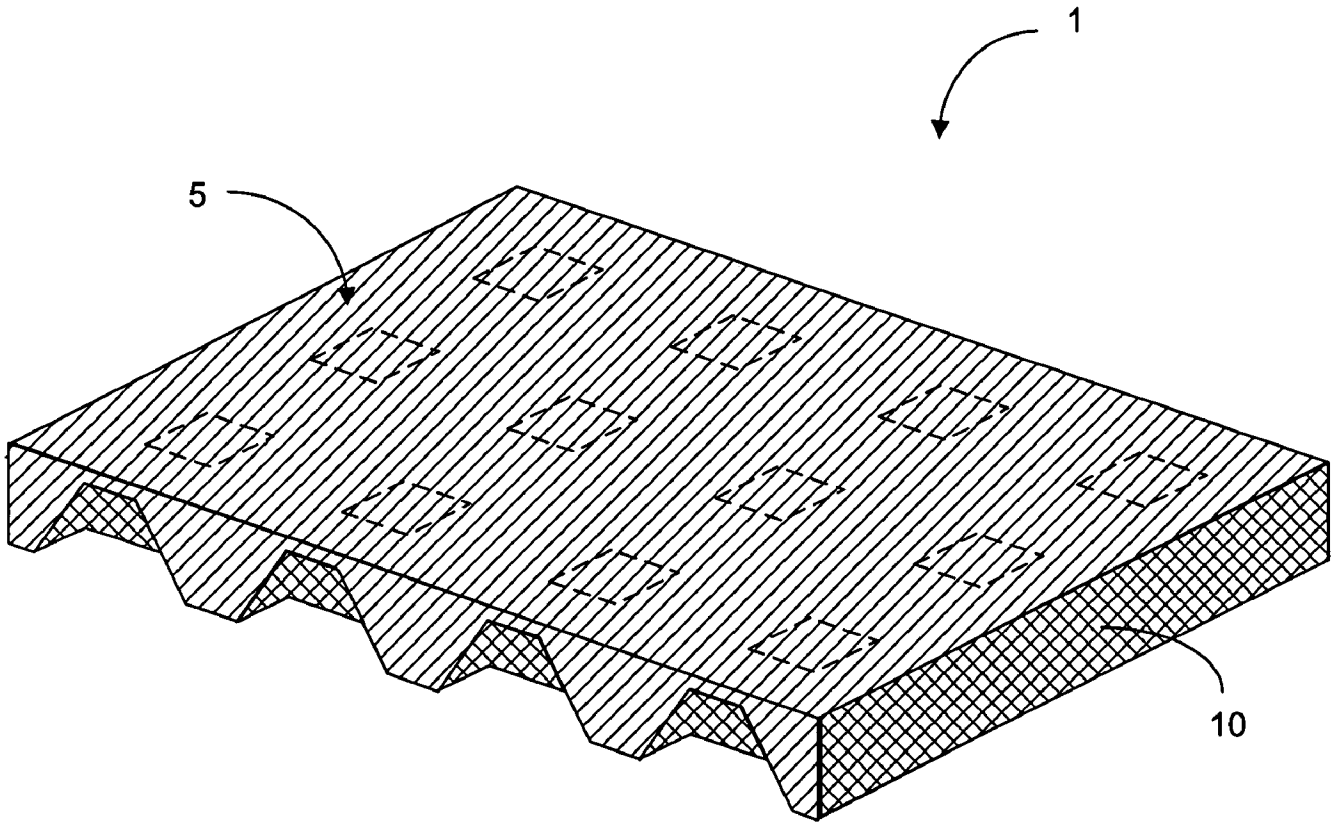
FIG. 3 shows an array of acoustic devices, according to various embodiments of the present invention.

FIG. 2 is a cross sectional view of the acoustic device of FIG. 1, showing the transducer 30 coupled to the cantilever diaphragm 20 on the substrate 10. As shown, the cantilever diaphragm 20 comprises a plurality of low temperature oxide (LTO) layers 42, 44, 46 on top of a silicon nitride layer 60. Below the silicon nitride layer 60, there is a thermal oxide layer 70, followed by a number of other layers, such as layer 80. The transducer 30 comprises a piezoelectric (PZT) layer 50 sandwiched between two LTO layers 42 and 44. On top of the transducer 30 is an electrode layer 40, while the bottom electrode layer 48 is below the PZT layer 50. It should be noted that the acoustic device, according to various embodiments of the present invention, can be produced as part of an array, as shown in FIG. 3. As shown in FIG. 3, an array 1 comprises a plurality of acoustic devices 5 produced on the same silicon substrate 10.

Figure 4:
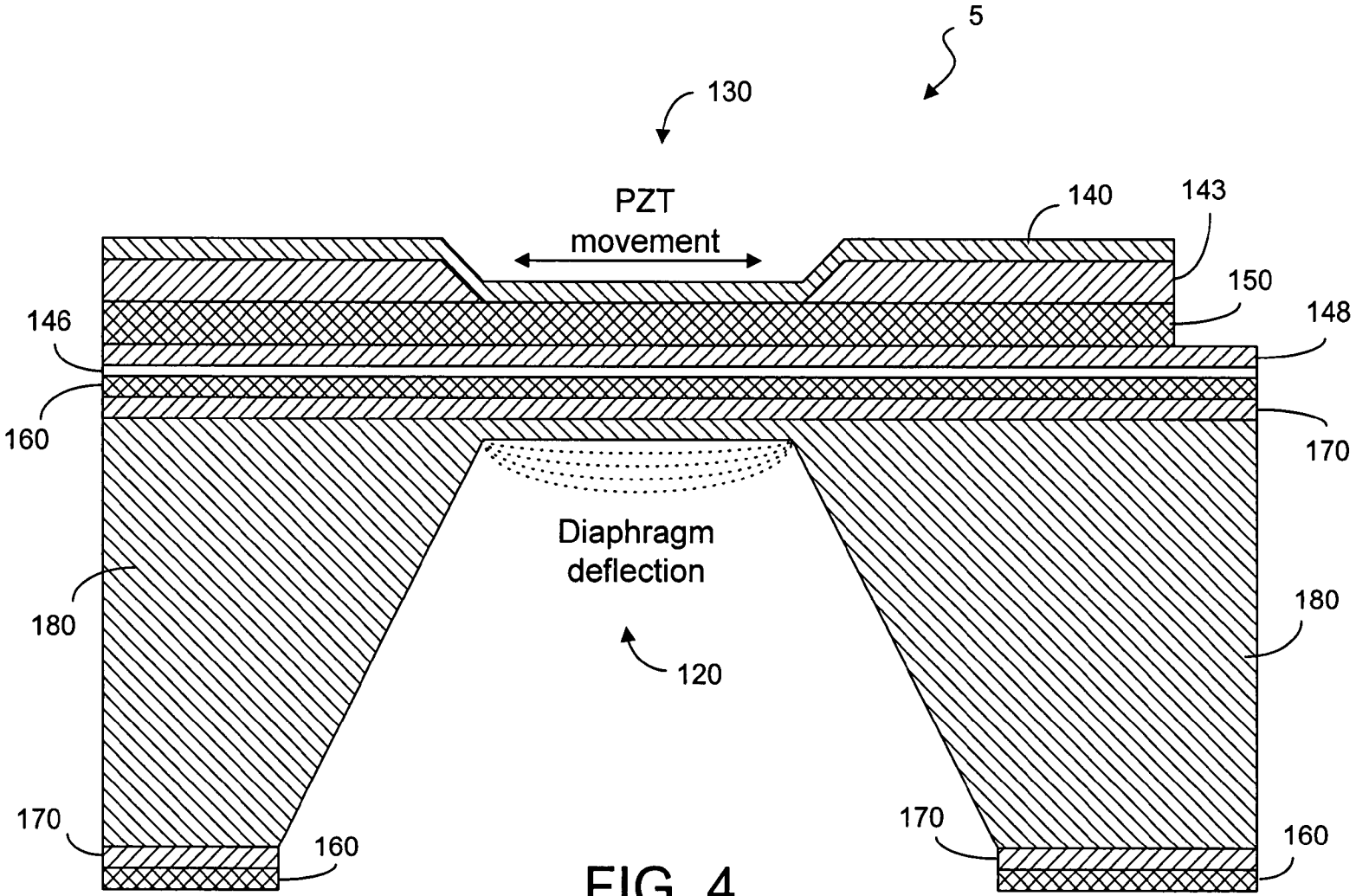
FIG. 4 shows a cross sectional view of an acoustic device, according to another embodiment of the present invention.

Another example of the acoustic device, according to a different embodiment of the present invention, is shown in FIG. 4. As shown in FIG. 4, the acoustic device 5 has a thin section on the silicon substrate 180 to be used as a diaphragm of the low frequency acoustic component 120. On top of the low frequency acoustic component 120, a transducer 130 having a piezoelectric (PZT) layer 150, and a polynitride layer 143 is provided. A top electrode layer 140 and a bottom electrode layer 148 are used to provide an excitation electrical signal in order to induce the movement of the PZT layer 150. The transducer 130 is coupled to the low frequency acoustic component 120 via a plurality of layers, including an LTO layer 146, a silicon nitride layer 160 and silicon dioxide layer 170.

Figure 5:
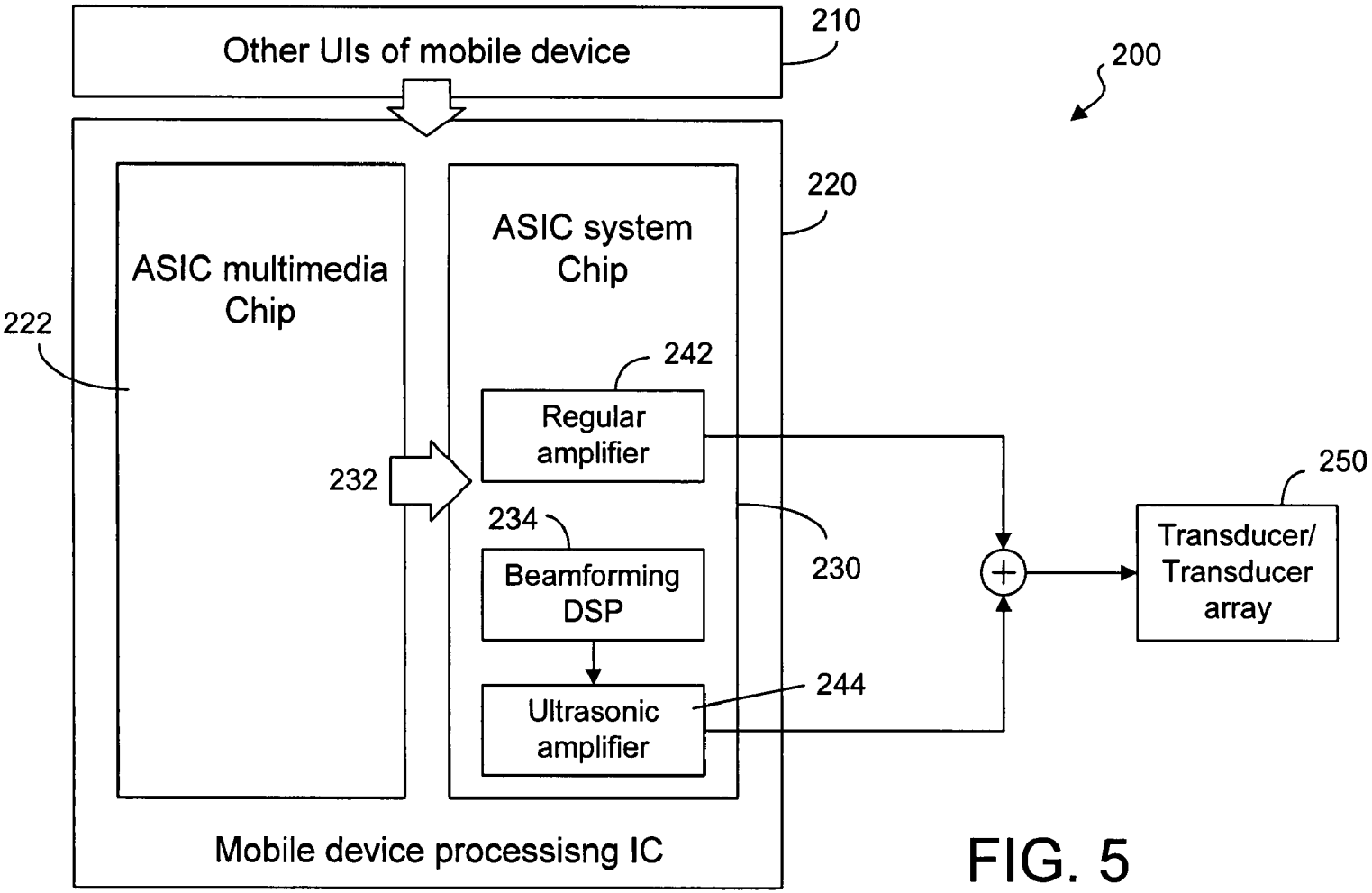
FIG. 5 is a block diagram showing an exemplary module for use in producing sound in conjunction with the acoustic device, according to the present invention.

FIG. 5 also shows a system architecture of the acoustic device. As shown in FIG. 5, the sound producing module 200 is used in an apparatus, such as a mobile terminal (see FIGS. 8 and 9). The module 200 comprises a mobile device processing IC 220 configured to receive information or commands from a user interface 210. The processing IC 220 comprises an application specific integrated circuit (ASIC) multimedia chip 222 and an ASIC system chip 230. The ASIC multimedia chip 222 can be configured to receive audio data from another mobile station or a multimedia streaming source, or from its own audio data storage or generating module, for example. The audio data from the ASIC multimedia chip 222 can be turned into electrical signal indicative of the audio data. According to the present invention, the audible sound indicative of the audio data can be produced in different ways depending upon a signal 232 from the ASIC multimedia chip. If the signal 232 indicates that the sound will be produced similar to that by a regular speaker, then the electrical signal indicative of the audio data is directed to a regular amplifier 242. The low frequency electrical output (in the range of 20 Hz to 20 kHz, for example) from the regular amplifier 242 is provided to the transducer or transducer array 250 so that an audible sound can be produced in the low frequency acoustic component (component 20 in FIG. 2, or component 120 in FIG. 4, for example). If the signal 232 indicates that the sound the sound will be produced as directional acoustic waves, then the electrical signal will be conveyed to a beam-forming data signal processor (DSP) 234 so that a high frequency carrier signal modulated by the audio data (or signal) is provided to an ultrasonic amplifier 244. The output from the ultrasonic amplifier 244 is also provided to the transducer or transducer array 250 so that ultrasonic waves are produced directly by the transducer or transducer array (component 30 in FIG. 2 or component 130 of FIG. 4, for example). Ultrasonic waves produced by a transducer or a transducer arrays as depicted in FIGS. 2 and 4 can be directional in that the wave pattern is confined to a narrow solid angle as illustrated in FIG. 6.

Figure 6:
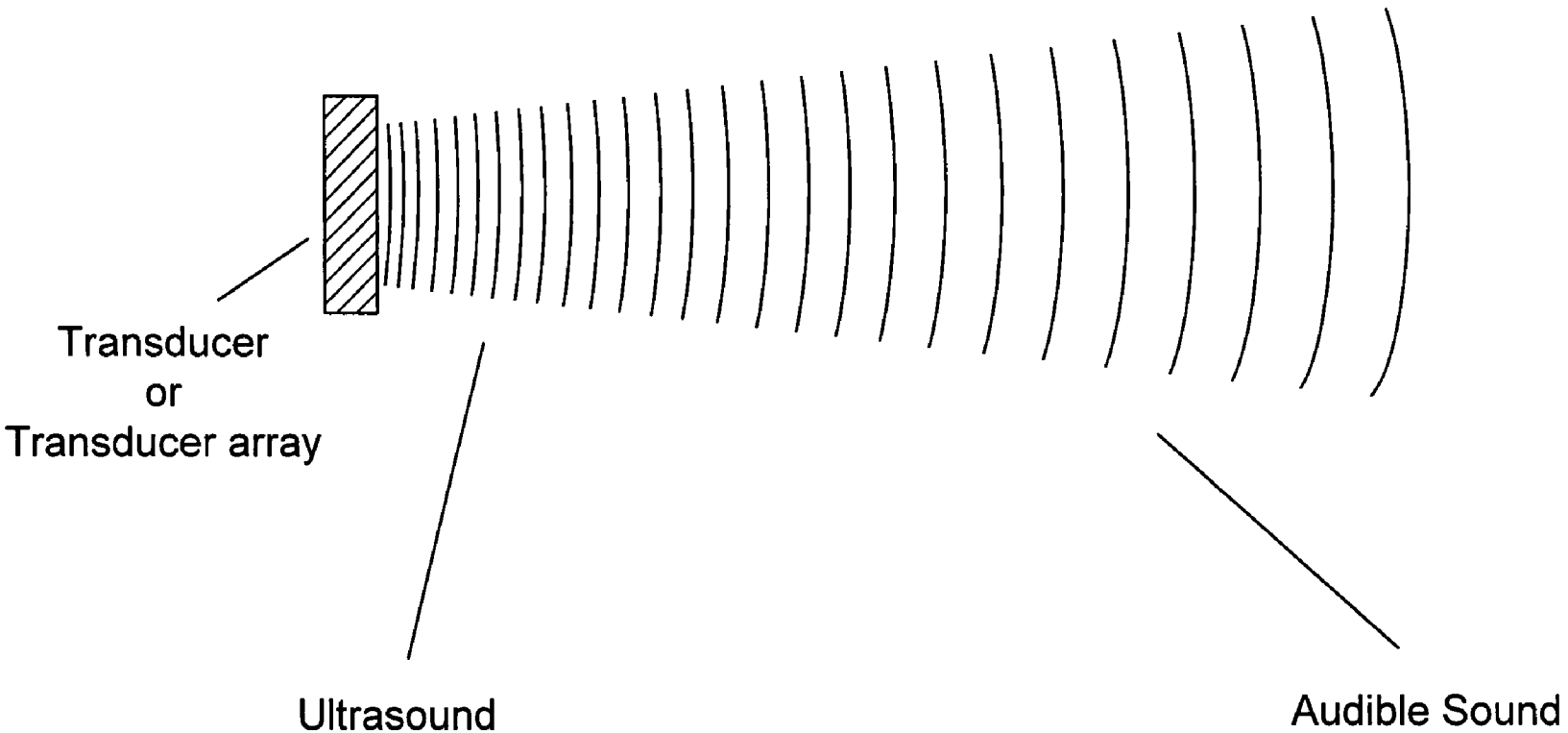
FIG. 6 shows a directional sound pattern of the acoustic waves, according to the present invention.

As shown in FIG. 6, the waves (carrier waves modulated by audio signal) in the near field are in the ultrasonic frequency and, therefore, not audible. As the waves travel through air, the carrier frequencies are lost due to the non-linear interaction of ultrasonic waves in the air. The envelope of the modulated waves produces audible sound while retaining at least part of the directivity of the wave pattern. As such, the audible sound produced by a device is largely confined to a small number of people.

Figure 7:
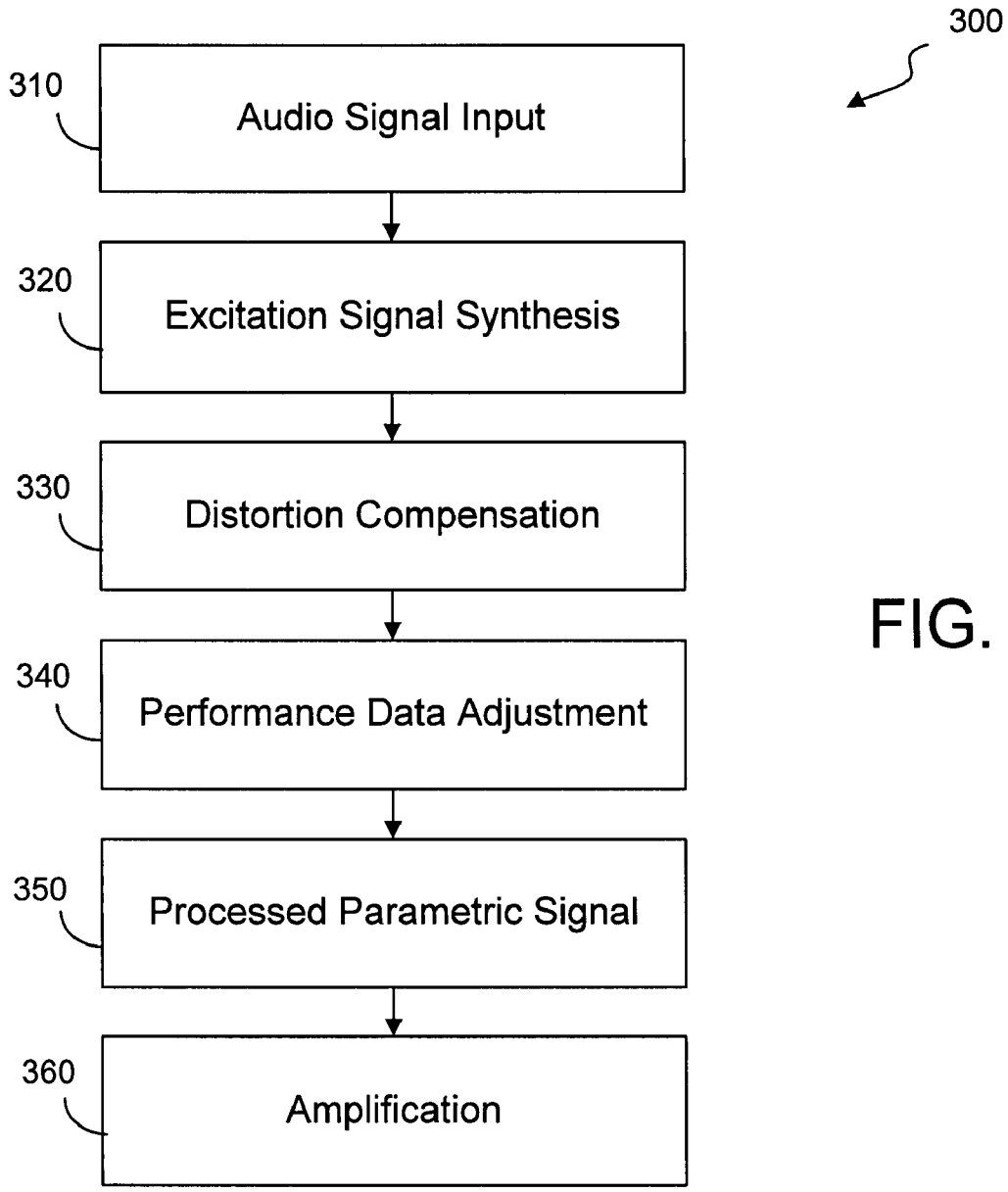
FIG. 7 is a flowchart of algorithms for generating parametric sound beams.

FIG. 7 is a flowchart of algorithms for generating parametric sound beams, regarding the directional beam. As show in the flow-chart 300, an audio input signal 310 is conveyed to an excitation signal synthesis module 320 where the input signal 310 is modulated by a carrier signal. The carrier signal has a frequency within the ultrasonic frequency range of 30 kHz to 120 kHz, for example. The modulate signal is processed in a distortion compensation module 330 in order to remove distortion caused by excitation signal synthesis process (block 320) as well as by amplifier and transducer, for example. The signal is again processed in a performance data adjustment module 340 to become a processed parametric signal 350 so that the specific performance parameters (such as the directional audio beam angle and traversing distance, for example) can be implemented. The processed parametric signal 350 is conveyed to an amplification stage 360. The amplification stage comprises the transducer or transducers (block 250 of FIG. 5, for example) via an optional amplifier (block 244 of FIG. 5, for example).

Figure 8:
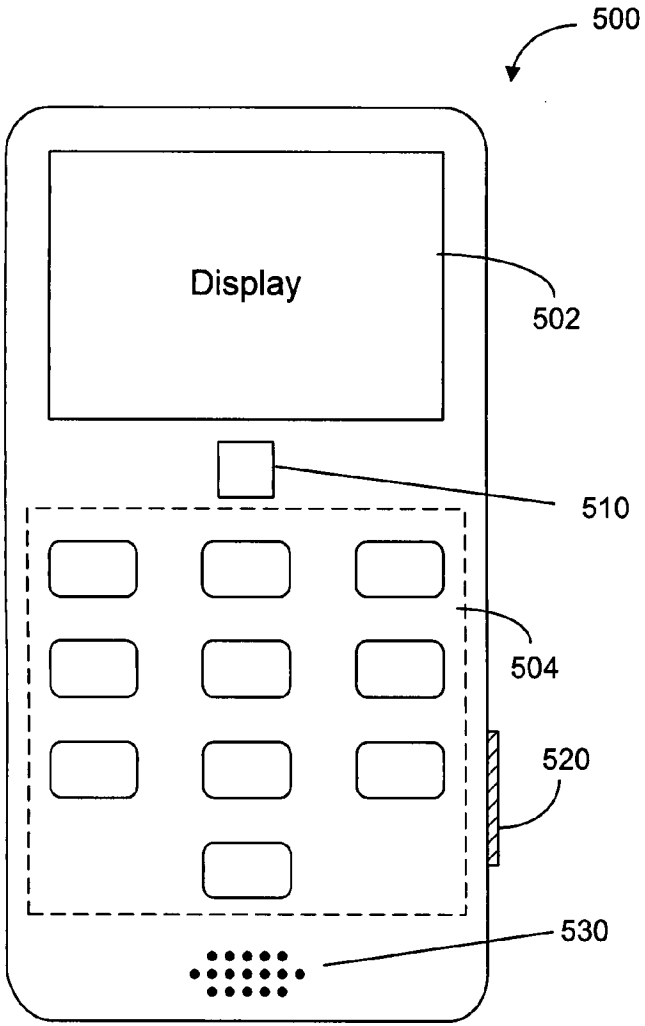
FIG. 8 shows an electronic device having an acoustic device, according to various embodiments of the present invention.

The acoustic device, according to various embodiments of the present invention, can be implemented in an electronic device or telecommunications apparatus that is configured to produce sounds. As shown in FIG. 8, an electronic device 500 has a display device 502 and a keypad 504. The electronic device has a speaker or sound producing device 510 and a microphone 530. The sound producing device 510 comprises an acoustic device 5. It is possible to provide a user interface 520 on the electronic device 500 to allow the user to select between the wide-beam audio mode or the narrow-beam audio mode.

Figure 9:
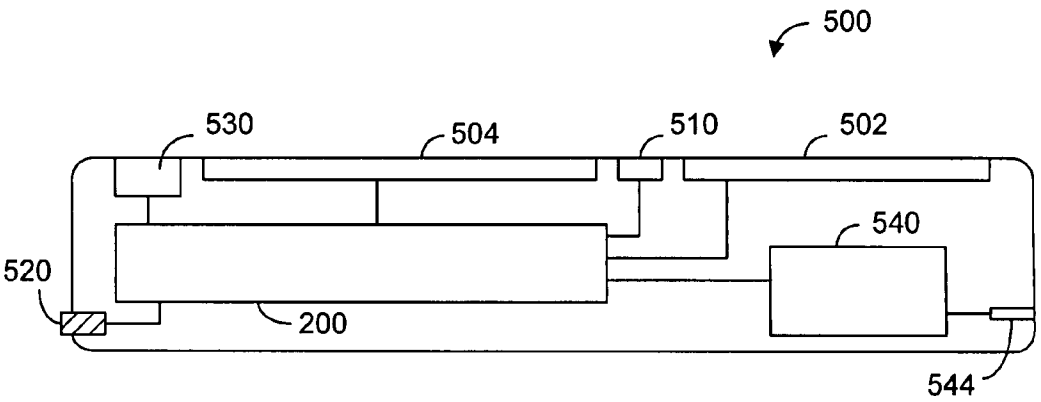
FIG. 9 shows various components in the electronic device of FIG. 8.

FIG. 9 shows an exemplary arrangement of various components in the electronic device of FIG. 8. As shown in FIG. 9, the electronic device 500 includes a user interface 520 for selecting to audio modes. The user interface 520 is connected to a processing IC 220 in the module 200 (see FIG. 5). The electronic device 500 also includes a display device, such as a liquid crystal display panel 502. The electronic device 500 can be used as a communications apparatus, such as a mobile terminal, having a transceiver 540 for transmitting and receiving signals via an antenna 544, for example.

In sum, the present invention provides a method and an apparatus for producing audible sounds. The apparatus combines the transducer for both a conventional loudspeaker and a directional loudspeaker in the same structural component. In the present invention, the transducer of the loudspeaker works in such a way that its low frequency characteristic satisfies the requirements of the conventional loudspeaker, while one of natural frequencies of the transducer is located in the ultrasonic range. As such, when the input exciting signal of the transducer (or transducer array) is a conventional audio signal, the transducer can produce conventional audio waves by working on its low frequency range. On the other hand, when the input signal of the transducer (or transducer array) is the ultrasonic signal modulated by audio signal for creating better directivity, it can produce the ultrasonic signals by working near of the specific natural frequency of the transducer in the ultrasonic range as mentioned; then the nonlinear interaction of ultrasonic waves in air can reproduce directional audible sound. Therefore, a loudspeaker with both the conventional loudspeaker and the directional loudspeaker function can be realized by the same transducer (or transducer array).

According to various embodiments of the present invention, the selection of the audio mode can be carried out automatically or manually. For example, the processing IC 220 (FIG. 5) can be configured to set the acoustic mode to the narrow-beam audio mode as a default when acoustic device is caused to start producing sounds. The user then decides whether to keep the narrow-beam audio mode unchanged or to switch it to the wide-beam audio mode. Alternatively, the processing IC is programmed to select the audio modes based on the nature of the sound producing event or the use case of the device. For example, when the electronic device 500, such as a mobile terminal, receives a telephone phone call, the processing IC will automatically select the narrow-beam audio mode. But if the user turns on an MP3 program to listen to music or podcast, the wide-beam audio mode is automatically selected. The user then decides whether to change the current audio mode. The user can change or select the audio modes through the user interface 210.

Figure 10:
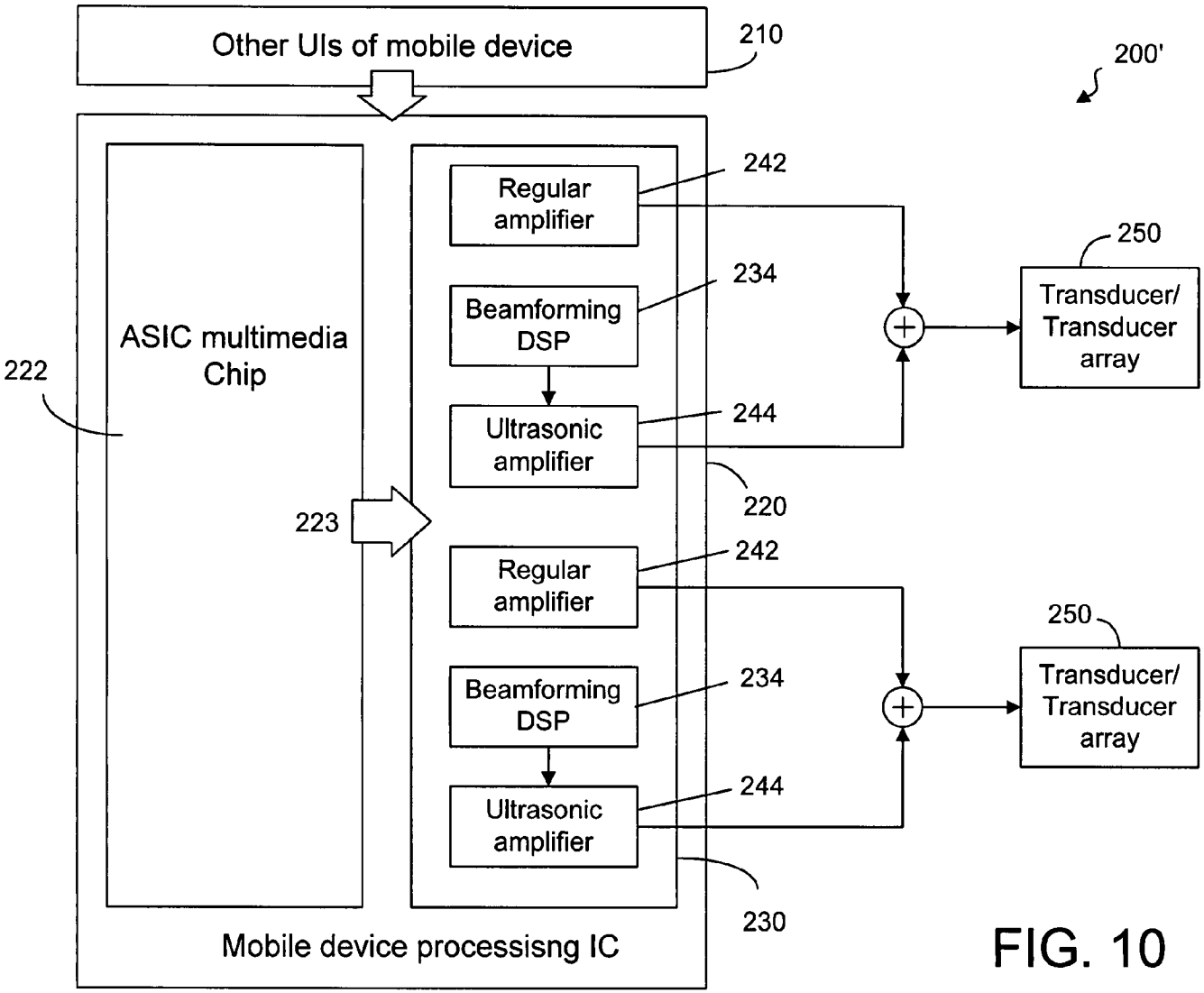
FIG. 10 shows a different sound producing module wherein two or more acoustic devices are used to produce sounds.

It should be noted that, according various embodiments of the present invention, the electronic device 500 allows a user to set playback to simultaneous in that the transducer or transducer array 250, as shown in FIG. 5, simultaneously receives electrical signals from the regular amplifier 242 and the ultrasonic amplifier 244. Alternatively, the electronic device 500 can have two or more transducers or transducer arrays to produce sounds in three or more modes. As shown in FIG. 10, the sound producing module 200' can be used in an apparatus, such as a mobile terminal (see FIGS. 8 and 9). The module 200' comprises a mobile device processing IC 220 configured to receive information or commands from a user interface 210. The processing IC 220 comprises an application specific integrated circuit (ASIC) multimedia chip 222 and an ASIC system chip 230. The ASIC multimedia chip 222 can be configured to receive audio data from another mobile station or a multimedia streaming source, or from its own audio data storage or generating module, for example. The ASIC system chip 230 can be configured to control a plurality of regular amplifiers 242, a plurality of beam-forming data signal processors 234, a plurality of ultrasonic amplifiers 244 and a plurality of transducers or transducer arrays 250. As such, the sound producing module 200' can be used to play back in at least three different modes:

1) two transducers 250 are caused to produce wide-beam audio sounds simultaneously;

2) two transducers 250 are caused to produce narrow-beam audio sounds simultaneously; and 3) one transducer 250 produces narrow-beam audio sounds, while the other transducer 250 produces wide-beam audio sounds simultaneously.

The sounds from different transducers can be the same or different. The sounds can be stereo sounds, for example.

Mode selection can be achieved by a signal 223 from the ASIC multimedia chip 222, for example. The user is allowed to decide which mode to be selected.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. An apparatus, comprising:

an acoustic component configured to produce acoustic waves in at least one of a lower frequency range and a higher frequency range, the lower frequency range comprising at least part of an audible frequency range and the higher frequency range comprising a frequency range higher than the audible frequency range, wherein the acoustic waves in the lower frequency range are produced in response to an electrical output in the lower frequency range.

2. The apparatus of claim 1, wherein the higher frequency range comprises at least part of an ultrasonic frequency range, and the acoustic component comprises a transducer configured to receive electrical signals for producing vibration in the ultrasonic frequency range based on the electrical signals.

3. The apparatus of claim 2, wherein the electrical signals comprise an audible signal modulated by a carrier signal in the ultrasonic frequency range.

4. The apparatus of claim 2, wherein the transducer is also configured to produce vibration in the lower frequency range based on the electrical signals.

5. The apparatus of claim 4, further comprising:

a deflectable component coupled to the transducer for producing the acoustic waves in response to the vibration.

6. The apparatus of claim 1, wherein the acoustic component comprises:

a substrate having a first side and an opposing second side, wherein a second side comprises a cavity defining a deflectable area on the substrate;

a piezoelectric layer; and a pair of electrodes coupled to the piezoelectric layer, the electrodes arranged to receive electrical signals so as to cause the piezoelectric layer to vibrate and wherein part of the deflectable area is acoustically coupled to the piezoelectric layer for producing the acoustic waves in response to vibration of the piezoelectric layer.

7. The apparatus of claim 6, wherein the higher frequency range comprises at least part of an ultrasonic frequency range, and wherein the piezoelectric layer is configured to produce the vibration in the ultrasonic frequency range based on the electrical signals.

8. The apparatus of claim 7, wherein the piezoelectric layer is also configured to vibrate in the lower frequency range based on the electrical signals.

9. The apparatus of claim 1, wherein the acoustic component comprises:

a substrate having a first side and an opposing second side, wherein a second side comprises an array of cavities, each cavity defining a deflectable area on the substrate;

a plurality of piezoelectric layer segments; and a pair of electrodes coupled to the piezoelectric layers, the electrodes arranged to receive electrical signals so as to cause the piezoelectric layers to vibrate and wherein each of the deflectable areas is acoustically coupled to one of the piezoelectric layers for producing the acoustic waves in response to vibration of the piezoelectric layers.

10. The apparatus of claim 9, wherein the piezoelectric layers are also configured to vibrate in the lower frequency range based on the electrical signals.

11. The apparatus of claim 6, wherein the substrate comprises a silicon substrate.

12. The apparatus of claim 5, wherein the deflectable component is configured to produce audible sounds when the transducer produces vibration in the ultrasonic frequency range.

13. The apparatus of claim 12, wherein the acoustic component is operable in a first audio mode to produce the acoustic waves in the lower frequency range and in a second audio mode to produce the acoustic waves in the higher frequency range, said apparatus further comprising:

a processor, coupled to the acoustic component, for selecting between the first audio mode and the second audio mode.

14. The apparatus of claim 13, further comprising:

a user interface, coupled to the processor, for selecting between the first audio mode and the second audio mode.

15. The apparatus of claim 13, comprising a mobile terminal.

16. The apparatus of claim 5, further comprising:

a second acoustic component configured to produce further acoustic waves in the lower frequency range or in the higher frequency range, and the second acoustic component comprises a second transducer configured to receive further electrical signals for producing further vibration in the ultrasonic frequency range based on the further electrical signals and a second deflectable component coupled to the second transducer for producing the further acoustic waves based on the further vibration, wherein the acoustic component is operable in various sound modes, the sound modes comprising a first audio mode to produce the acoustic waves in the lower frequency range and in a second audio mode to produce the acoustic waves in the higher frequency range, and wherein the second acoustic component is operable in various further sound modes, the further sound modes comprising a first audio mode to produce the further acoustic waves in the lower frequency range and in a second audio mode to produce the further acoustic waves in the higher frequency range, said apparatus further comprising:

a processor, coupled to the acoustic component and the further acoustic component, for selecting different combinations of the sound modes and the further sound modes.

17. A method comprising:

providing an acoustic component configured to produce acoustic waves in at least one of a lower frequency range and a higher frequency range, the lower frequency range comprising at least part of an audible frequency range and the higher frequency range comprising a frequency range higher than the audible frequency range, wherein the acoustic waves in the lower frequency range are produced in response to an electrical output in the lower frequency range; and exciting the acoustic component for producing acoustic waves in the lower frequency range or in the higher frequency range.

18. The method of claim 17, wherein the higher frequency range comprises at least part of an ultrasonic frequency range, and the acoustic component comprises a transducer configured to receive electrical signals for producing vibration in the ultrasonic frequency range based on the electrical signals.

19. The method of claim 18, further comprising:

modulating an audible signal by a carrier signal in the ultrasonic frequency range for producing the electrical signals.

20. The method of claim 18, wherein the transducer is also configured to produce vibration in the lower frequency range based on the electrical signals.

21. The method of claim 20, further comprising:

coupling a deflectable component to the transducer for producing the acoustic waves in response to the vibration.

22. An apparatus, comprising:

means for producing vibration in at least one of a lower frequency range and a higher frequency range, the lower frequency range comprising at least part of an audible frequency range and the higher frequency range comprising a frequency range higher than the audible frequency range; and means for producing acoustic waves, in response to the vibration in the lower frequency range and in the higher frequency range.

23. The apparatus of claim 22, wherein the higher frequency range comprises at least part of an ultrasonic frequency range, and wherein said means for producing vibration comprises one or more transducers configured to receive electrical signals for producing the vibration in the based on electrical signals.

24. The apparatus of claim 23, further comprising:

means for modulating an audible signal by a carrier signal in the ultrasonic frequency range for producing the electrical signals.

25. The apparatus of claim 1, wherein the acoustic waves in the lower frequency range are produced in a wider beam and the acoustic waves in the higher frequency range are produced in a narrower beam.

26. The method of claim 17, wherein the acoustic waves in the lower frequency range are produced in a wider beam and the acoustic waves in the higher frequency range are produced in a narrower beam.

* * * * *